US008736597B2

(12) United States Patent
Kim

(10) Patent No.: US 8,736,597 B2
(45) Date of Patent: May 27, 2014

(54) PIXEL FOR DISPLAY DEVICE, DISPLAY DEVICE, AND DRIVING METHOD THEREOF

(75) Inventor: Hyung-Soo Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 233 days.

(21) Appl. No.: 13/179,401

(22) Filed: Jul. 8, 2011

(65) Prior Publication Data

US 2012/0146990 A1 Jun. 14, 2012

(30) Foreign Application Priority Data

Dec. 10, 2010 (KR) ..... 10-2010-0126490

(51) Int. Cl.
*G09G 3/30* (2006.01)

(52) U.S. Cl.
USPC ..... 345/214; 345/690

(58) Field of Classification Search
CPC . G09G 3/3258; G09G 3/3685; G09G 3/3696; G09G 2310/0264
USPC ..... 345/76, 82, 204, 211, 212, 214, 690; 315/167, 169.1, 169.3, 209 R
See application file for complete search history.

(56) References Cited

U.S. PATENT DOCUMENTS

| | | | | |
|---|---|---|---|---|
| 8,344,975 | B2 * | 1/2013 | Shirouzu et al. | 345/82 |
| 8,368,619 | B2 * | 2/2013 | Tsai et al. | 345/76 |
| 8,432,342 | B2 * | 4/2013 | Kim | 345/84 |
| 2004/0207614 | A1 * | 10/2004 | Yamashita et al. | 345/211 |
| 2006/0022605 | A1 * | 2/2006 | Ha et al. | 315/169.3 |
| 2006/0077194 | A1 * | 4/2006 | Jeong | 345/204 |
| 2006/0232521 | A1 * | 10/2006 | Jang et al. | 345/76 |
| 2006/0256057 | A1 * | 11/2006 | Han et al. | 345/92 |
| 2007/0268220 | A1 * | 11/2007 | Lee et al. | 345/76 |
| 2008/0150847 | A1 * | 6/2008 | Kim et al. | 345/82 |
| 2009/0251452 | A1 * | 10/2009 | Kang et al. | 345/211 |
| 2009/0309516 | A1 * | 12/2009 | Kim | 315/307 |
| 2010/0164847 | A1 * | 7/2010 | Lee et al. | 345/77 |
| 2010/0194716 | A1 * | 8/2010 | Park | 345/204 |
| 2011/0157126 | A1 * | 6/2011 | Chung et al. | 345/211 |
| 2012/0013581 | A1 * | 1/2012 | Nathan et al. | 345/204 |
| 2012/0050350 | A1 * | 3/2012 | Matsui | 345/690 |
| 2012/0062536 | A1 * | 3/2012 | Park | 345/211 |
| 2013/0069926 | A1 * | 3/2013 | Park et al. | 345/211 |
| 2013/0286000 | A1 * | 10/2013 | Han et al. | 345/212 |

FOREIGN PATENT DOCUMENTS

| | | | |
|---|---|---|---|
| JP | 2004-246320 | A | 9/2004 |
| KR | 10-2005-0100888 | A | 10/2005 |
| KR | 10-2007-0025765 | A | 3/2007 |

* cited by examiner

*Primary Examiner* — Joe H Cheng
(74) *Attorney, Agent, or Firm* — Knobbe Martens Olson & Bear LLP

(57) ABSTRACT

A pixel for a display device is disclosed. In one aspect the pixel includes six transistors. For example, the pixel may includes an organic light emitting diode, a first transistor transmitting a first power source voltage to an anode of the organic light emitting diode, a second transistor transmitting a gate-on voltage to the gate electrode of the first transistor, a third transistor transmitting a gate-off voltage to the gate electrode of the first transistor according to a first control signal, a fourth transistor transmitting the gate-off voltage to the gate electrode of the second transistor according to the first control signal, a fifth transistor transmitting the second control signal to the gate electrode of the second transistor, and a sixth transistor transmitting the gate-on voltage to the gate electrode of the fifth transistor according to a third control signal. The pixels in the display are turned off for initialization and the pixels are selectively turned on to display an image.

22 Claims, 6 Drawing Sheets

PIXEL FOR DISPLAY DEVICE, DISPLAY DEVICE, AND DRIVING METHOD THEREOF

CROSS-REFERENCE TO RELATED APPLICATIONS

This application claims priority to and the benefit of Korean Patent Application No. 10-2010-0126490 filed in the Korean Intellectual Property Office on Dec. 10, 2010, the entire contents of which are incorporated herein by reference.

BACKGROUND

1. Field

The disclosed technology relates a pixel for a display device, a display device using the pixel, and a driving method thereof. More particularly, the disclosed technology relates to a pixel for a display device using a digital driving method to reduce power consumption, a display device using the pixel, and the driving method.

2. Description of the Related Technology

Currently, various flat panel displays having reduced weight and volume as compared to cathode ray tubes have been developed. Technologies for flat panel displays include liquid crystal displays (LCD), field emission displays (FED), plasma display panels (PDP), and organic light emitting diode displays (OLED).

A flat panel display includes a display panel including a plurality of pixels arranged in a matrix format. The display panel includes a plurality of scan lines in a row direction and a plurality of data lines in a column direction, and the plurality of scan lines and the plurality of data lines cross. The plurality of pixels are driven by scan signals and data signals transmitted through the scan lines and data lines.

The flat panel display is classified into passive matrix light emitting display devices and an active matrix light emitting display devices according to a driving method thereof. The active matrix display, which selectively turns on/off the pixels may be used because of its beneficial characteristics of resolution, contrast, and operation speed.

The active matrix type of light emitting display device is generally driven with an analog driving method or a digital driving method. While the analog driving method produces grayscale with a variable voltage level of the data, the digital driving method produces grayscale with a variable time duration for which the data voltage is applied. The analog driving method has a difficulty in manufacturing a driving IC (integrated circuit) with a large size and high resolution of a panel, the digital driving method may realize the high resolution through a simpler IC structure. Also, the digital driving method uses on and off states of a driving TFT (thin film transistor) that is seldom influenced by image quality deterioration due to a TFT characteristic deviation. Therefore, digital driving methods are useful for a large panel. Also, the digital driving method seldom has a significant voltage difference between both terminals of a driving TFT when compared with an analog driving method. Accordingly, the digital driving method has the merit that the power consumption for electro-luminescence is low.

However, in the digital driving method, the data must be applied to the data line with a high speed, and thereby power consumption for charge and discharge of the data line is increased compared with the analog driving method. Particularly, as the panel is large and the resolution is high, the application speed of the data must be further increased. As the application speed of the data is increased, the power consumption for charge and discharge of the data line is further increased.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a pixel for a display device. The pixel includes an organic light emitting diode (OLED), a first transistor configured to transmit a first power source voltage to an anode of the organic light emitting diode (OLED), a second transistor configured to transmit a gate-on voltage to the gate electrode of the first transistor, and a third transistor configured to transmit a gate-off voltage to the gate electrode of the first transistor according to a first control signal. The pixel also includes a fourth transistor configured to the gate-off voltage to the gate electrode of the second transistor according to the first control signal, a fifth transistor configured to transmit a second control signal to the gate electrode of the second transistor, and a sixth transistor configured to transmit the gate-on voltage to the gate electrode of the fifth transistor according to a third control signal.

Another inventive aspect is a display device including a display unit including a plurality of pixels, a scan driver configured to sequentially apply to the display unit a scan signal selecting one pixel row of a plurality of pixel rows, a data driver configured to apply to the display unit a data signal selectively turning on one pixel of the plurality of pixels included in the one pixel row, and an initialization driver configured to apply an initialization signal substantially simultaneously turning off the plurality of pixels to the display unit. The plurality of pixels respectively include an organic light emitting diode (OLED), a first transistor configured to transmit a first power source voltage to an anode of the organic light emitting diode (OLED), a second transistor configured to transmit a gate-on voltage to the gate electrode of the first transistor, and a third transistor configured to transmit a gate-off voltage to the gate electrode of the first transistor according to a first control signal. Each pixel also includes a fourth transistor configured to transmit a gate-off voltage to the gate electrode of the second transistor according to the initialization signal, a fifth transistor configured to transmit the data signal to the gate electrode of the second transistor, and a sixth transistor configured to transmit the gate-on voltage to the gate electrode of the fifth transistor according to the scan signal.

Another inventive aspect is a method of driving a display device. The method includes transmitting an off signal to a plurality of pixels to turn off a first transistor transmitting a first power source voltage to an anode of an organic light emitting diode (OLED) and to turn off a second transistor turning on the first transistor. The method also includes applying a scan signal to one pixel row of a plurality of pixel rows and applying a data signal selectively turning on one pixel of the plurality of pixels included in the one pixel row, whereby the second transistor of the one pixel is turned on by the data signal and the gate-on voltage is transmitted to the first transistor of the one pixel through the turned on second transistor to turn on the first transistor to provide current to the organic light emitting diode (OLED).

DETAILED DESCRIPTION OF CERTAIN INVENTIVE EMBODIMENTS

Figure 1:
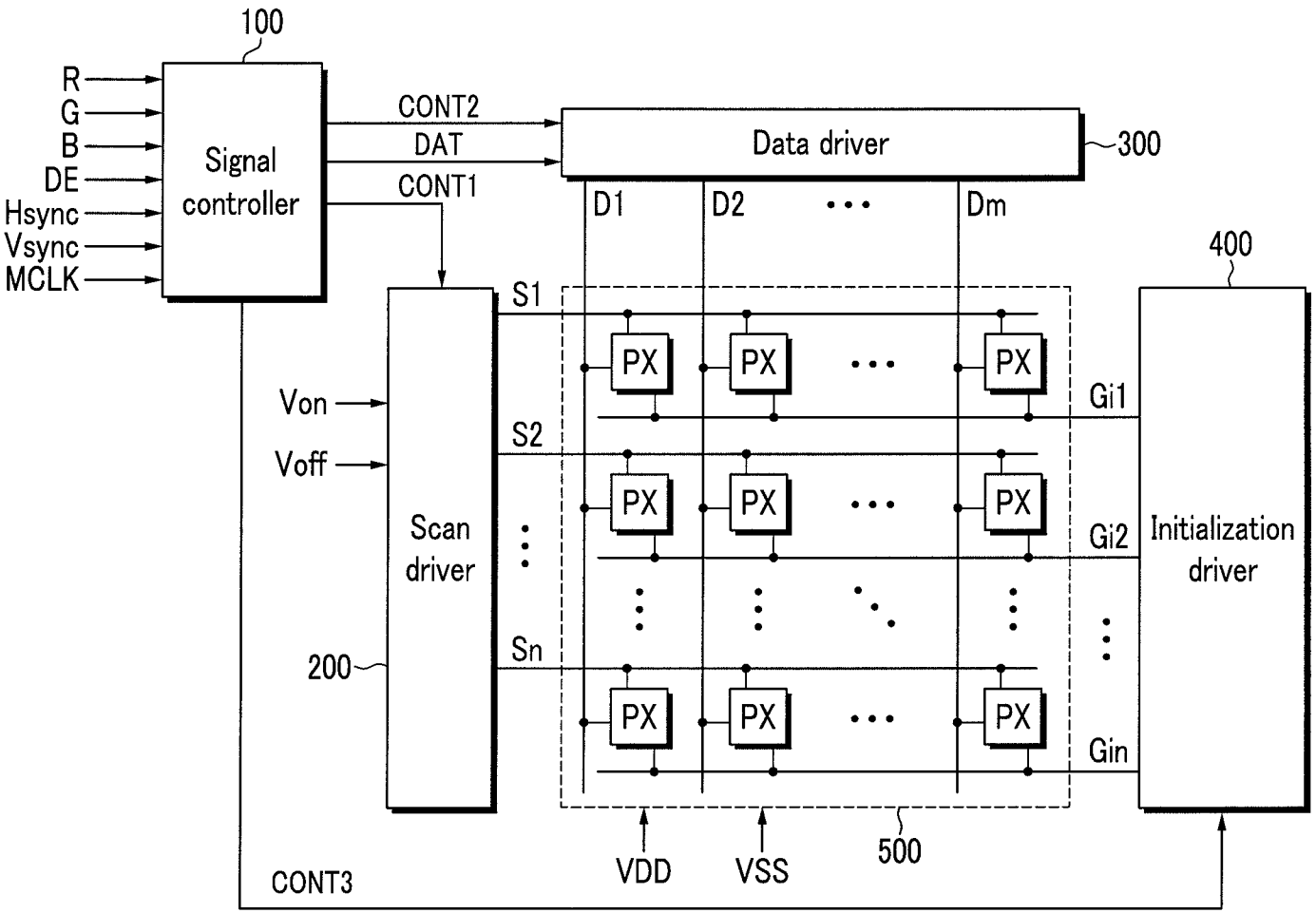
FIG. 1 is a block diagram of a display device according to an exemplary embodiment.

Various inventive aspects and features are described more fully hereinafter with reference to the accompanying drawings, in which exemplary embodiments are shown. As those skilled in the art would realize, the described embodiments may be modified in various ways, without departing from the spirit or scope of the present invention.

Further, in several exemplary embodiments, constituent elements having the same configuration are representatively described in a first exemplary embodiment by using generally the same reference numerals, and only constituent elements different from the constituent elements described in a previous embodiment will generally be described in other embodiments.

In some cases, elements extrinsic to the description are omitted, and like reference numerals generally refer to like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment. Referring to FIG. 1, the display device includes a signal controller 100, a scan driver 200, a data driver 300, an initialization driver 400, and a display unit 500.

The signal controller 100 receives video signals R, G, and B that are input from an external device, and an input control signal that controls displaying thereof. The video signals R, G, and B include luminance information of each pixel PX, and the luminance has a grayscale having a predetermined number of levels, for example, $1024=2^{10}$, $256=2^{8}$, or $64=2^{6}$. As examples of the input control signal, there may be a vertical synchronization signal Vsync, a horizontal synchronization signal Hsync, a main clock signal MCLK, and a data enable signal DE.

The signal controller 100 appropriately processes the input video signals R, G, and B according to the operation mode of the display unit 500 and the data driver 300 on the basis of the input video signals R, G, and B and the input control signal, and generates a scan control signal CONT1, a data control signal CONT2, an initialization control signal CONT3, and an image data signal DAT. The signal controller 100 transmits the scan control signal CONT1 to the scan driver 200. The signal controller 100 transmits the data control signal CONT2 and the image data signal DAT to the data driver 300. The signal controller 100 transmits the initialization control signal CONT3 to the initialization driver 400.

The display unit 500 includes a plurality of scan lines S1-Sn, a plurality of data lines D1-Dm, a plurality of initialization lines Gi1-Gin, and a plurality of pixels PX connected to a plurality of signal lines S1-Sn, D1-Dm, and Gi1-Gin and arranged in a substantially matrix form. In this embodiment, the plurality of scan lines S1-Sn are extended in a row direction and are in parallel with each other, and the plurality of data lines D1-Dm are extended in a column direction and are in parallel with each other. The plurality of initialization lines Gi1-Gin are extended in the row direction and are in parallel with each other. In some embodiments, the plurality of initialization lines Gi1-Gin may be extended in the column direction and are in parallel with each other. The display unit 500 receives the first power source voltage VDD and the second power source voltage VSS from the outside.

The scan driver 200 is connected to the plurality of scan lines S1-Sn, and applies scan signals that include a combination of a gate-on voltage Von and a gate-off voltage Voff to the plurality of scan lines S1-Sn according to the scan control signal CONT1. The scan driver 200 may sequentially apply the scan signal to the plurality of scan lines S1-Sn.

The data driver 300 is connected to the plurality of data lines D1-Dm, and applies the data signals to the plurality of data lines D1-Dm according to the data control signal CONT2. The data driver 300 controls an input time or an input number of data signals according to the grayscale of the image data signal DAT to transmit the data signals to the display unit 500.

The initialization driver 400 is connected to the plurality of initialization lines Gi1-Gin, and applies the initialization signal to the plurality of initialization lines Gi1-Gin according to the initialization control signal CONT3.

The driving devices 100, 200, 300, and 400 may be directly mounted on the display unit 500 in the form of at least one integrated circuit chip, mounted on a flexible printed circuit film, attached to the display unit 500 in the form of a tape carrier package (TCP), or mounted on a separate printed circuit board (PCB). Alternatively, any or all of the driving devices 100, 200, 300, and 400 may be integrated in the display unit 500 together with the signal lines S1-Sn, D1-Dm, and Gi1-Gin.

The display device may be operated by a digital driving method controlling the input time or the input number of data signals input to the pixel PX according to the grayscale of the image data signal DAT. In the digital driving method, the data signal is a turn-on signal TO turning the driving transistor of the pixel on/off, the scan signal is a selection line signal SL selecting the scan line to which the turn-on signal TO will be applied among a plurality of scan lines Si-Sn, and the initialization signal is an entire off signal GO for initializing the entire pixel by turning them off. The turn-on signal TO is determined as a gate-off voltage and is changed into a gate-on voltage according to the data control signal CONT2. The entire off signal GO is determined as the gate-off voltage and is changed into the gate-on voltage according to the initialization control signal CONT3 and is applied to all pixels.

Figure 2:
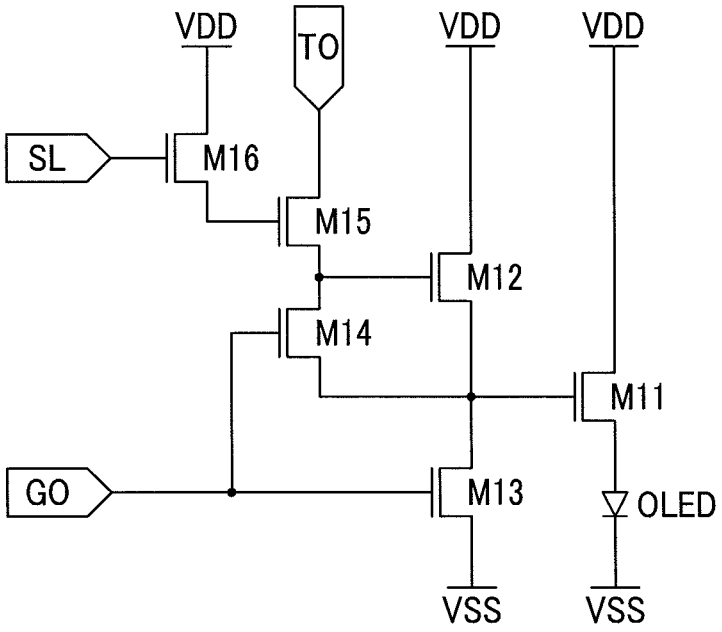
FIG. 2 is a circuit diagram of a pixel according to an exemplary embodiment.

FIG. 2 is a circuit diagram of a pixel according to an exemplary embodiment. Referring to FIG. 2, the pixel includes an organic light emitting diode OLED, a first transistor M11, a second transistor M12, a third transistor M13, a fourth transistor M14, a fifth transistor M15, and a sixth transistor M16.

The first transistor M11 includes a gate electrode connected to the other terminal of the second transistor M12 and the other terminal of the third transistor M13, one terminal applied with the first power source voltage VDD, and the other terminal connected to the anode of the organic light emitting diode OLED. The first transistor M11 transmits the first power source voltage VDD to the anode of the organic light emitting diode OLED. The first power source voltage VDD may be a logic high level voltage.

The second transistor M12 includes a gate electrode connected to the other terminal of the fourth transistor M14 and the other terminal of the fifth transistor M15, one terminal applied with the first power source voltage VDD, and the other terminal connected to the gate electrode of the first transistor M11. The second transistor M12 transmits the first power source voltage VDD to the gate electrode of the first transistor M11 according to the turn-on signal TO.

The third transistor M13 includes a gate electrode applied with the entire off signal GO, one terminal applied with the second power source voltage VSS, and the other terminal connected to the gate electrode of the first transistor M11. The third transistor M13 transmits the second power source voltage VSS to the gate electrode of the first transistor M11 according to the entire off signal GO. The entire off signal GO may be the first control signal to turn off all pixels for the initialization.

The fourth transistor M14 includes the gate electrode applied with the entire off signal GO, one terminal connected to the other terminal of the third transistor M13, and the other terminal connected to the gate electrode of the second transistor M12. The fourth transistor M14 transmits the second power source voltage VSS to the gate electrode of the second transistor M12. The second power source voltage VSS may be a logic low level voltage.

The fifth transistor M15 includes a gate electrode connected to the other terminal of the sixth transistor M16, one terminal applied with the turn-on signal TO, and the other terminal connected to the gate electrode of the second transistor M12. The fifth transistor M15 transmits the turn-on signal TO to the gate electrode of the second transistor M12. The turn-on signal TO is the signal selectively applied as the logic high level voltage by the data driver 300. The turn-on signal TO may be the second control signal selectively turning on the pixel.

The sixth transistor M16 includes a gate electrode applied with the selection line signal SL, one terminal applied with the first power source voltage VDD, and the other terminal connected to the gate electrode of the fifth transistor M15. The sixth transistor M16 transmits the first power source voltage VDD to the gate electrode of the fifth transistor M15 according to the selection line signal SL. The selection line signal SL may be the third control signal to select one pixel row among the plurality of pixels included in the display unit 500.

The organic light emitting diode OLED includes an anode connected to the other terminal of the first transistor M11 and a cathode applied with the second power source voltage VSS. The organic light emitting diode OLED may emit light of one of multiple primary colors. The primary colors include, for example, three primary colors of red, green, and blue, and a desired color is displayed with a spatial or temporal sum of the three primary colors.

The first transistor M11, the second transistor M12, the third transistor M13, the fourth transistor M14, the fifth transistor M15, and the sixth transistor M16 may be n-channel or p-channel field effect transistors with appropriate signal polarities. In the embodiment of FIG. 2, the gate-on voltage turning on the first transistor M11, the second transistor M12, the third transistor M13, the fourth transistor M14, the fifth transistor M15, and the sixth transistor M16 is a logic high level voltage, and the gate-off voltage turning them off is a logic low level voltage.

The first transistor M11, the second transistor M12, the third transistor M13, the fourth transistor M14, the fifth transistor M15, and the sixth transistor M16 are re-channel field effect transistors, however at least one of the first transistor M11, the second transistor M12, the third transistor M13, the fourth transistor M14, the fifth transistor M15, and the sixth transistor M16 may be a p n-channel field effect transistor, and the gate-on voltage for turning on the p-channel electric field effect transistor is the logic low voltage, and the gate-off voltage for turning it off is the logic high voltage.

Figure 3:
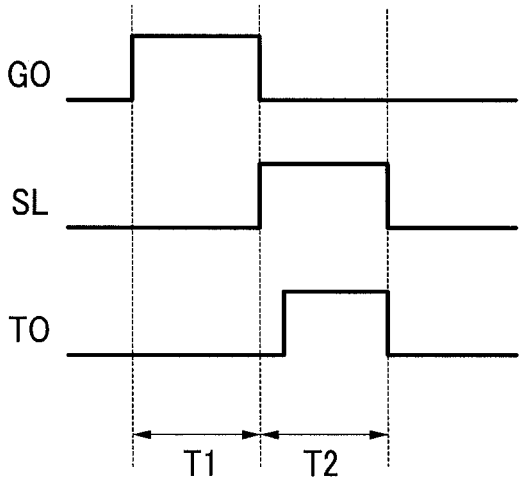
FIG. 3 is a timing diagram of a driving method of a display device according to an exemplary embodiment.

FIG. 3 is timing diagram of a driving method of a display device according to an exemplary embodiment. Referring to FIGS. 1 to 3, in the initialization period T1, the initialization driver 400 simultaneously applies the entire off signal GO of the logic high level to the plurality of initialization lines Gi1-Gin. Here, the selection line signal SL and the turn-on signal TO are applied as the logic low level voltage. The third transistor M13 and the fourth transistor M14 of all pixels are turned on by the entire off signal GO of the logic high level. The second power source voltage VSS is transmitted to the gate electrode of the first transistor M11 through the turned on third transistor M13. Also, the second power source voltage VSS is transmitted to the gate electrode of the gate electrode of the second transistor M12 through the turned on fourth transistor M14. Accordingly, the first transistor M11 and the second transistor M12 are turned off. That is, at the initialization period T1, all pixels included in the display unit 500 are turned off and initialized.

At the data writing period T2, the scan driver 200 sequentially applies the selection line signal SL of the logic high level to the plurality of scan lines S1-Sn. Also, the data driver 300 applies the turn-on signal TO of the logic high level to the data lines connected only to the pixels to emit light among the plurality of data lines D1-Dm. Here, the entire off signal GO is applied with the logic low level voltage. In the pixels to which the selection line signal SL and the turn-on signal TO of the logic high level are applied, the sixth transistor M16 is turned on by the selection line signal SL of the logic high level, and the first power source voltage VDD is transmitted to the gate electrode of the fifth transistor M15 through the turned on sixth transistor M16 to turn on the fifth transistor M15. The turn-on signal TO is transmitted to the gate electrode of the second transistor M12 through the turned on fifth transistor M15 to turn on second transistor M12. The first power source voltage VDD is transmitted to the gate electrode of the first transistor M11 through the turned on second transistor M12 to turn on the first transistor M11. The first power source voltage VDD is transmitted to the anode of the organic light emitting diode OLED through the turned on first transistor M11 such that the organic light emitting diode OLED emits light.

The initialization period T1 and the data writing period T2 in which the first power source voltage VDD is transmitted to the anode of the organic light emitting diode OLED may be repeated so as to have a total turned-on time during one frame based on the grayscale of the image data signal DAT. For example, if the number of times that the first power source voltage VDD is applied to the anode of the organic light emitting diode OLED is increased, the light emitting amount in the organic light emitting diode OLED is increased such that the image data signal DAT of a high grayscale may be expressed. That is, the display device inputs the first power source voltage VDD for the light emission of the organic light emitting diode OLED according to the grayscale of the image data signal DAT to display the grayscale of the image data signal DAT.

As described above, after all pixels are turned off by using the entire off signal GO for the initialization, the pixel to be turned on according to the grayscale of the image data may be selectively turned on by using the selection line signal SL and the turn-on signal TO, thereby reducing the power consumption for the data writing.

Figure 4:
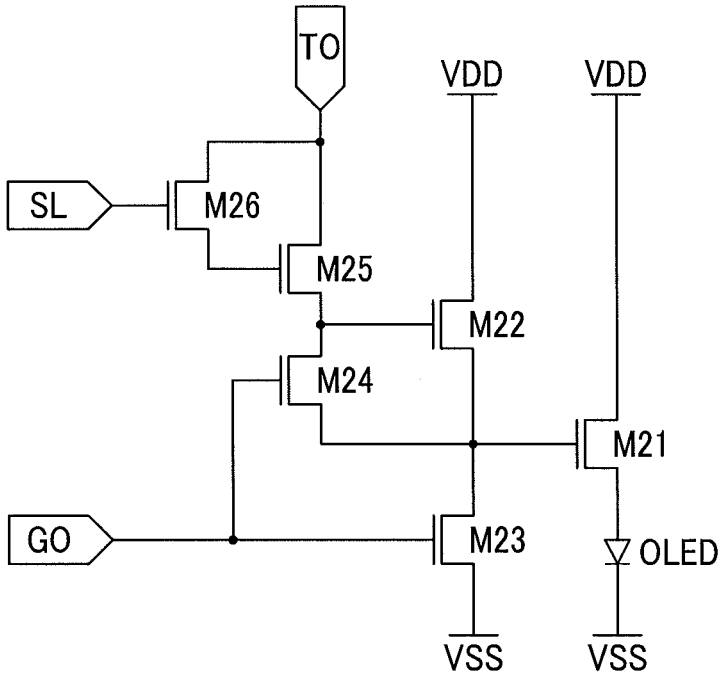
FIG. 4 is a circuit diagram of a pixel according to another exemplary embodiment.

FIG. 4 is a circuit diagram showing a pixel according to another exemplary embodiment. Referring to FIG. 4, the pixel includes an organic light emitting diode OLED, a first transistor M21, a second transistor M22, a third transistor M23, a fourth transistor M24, a fifth transistor M25, and a sixth transistor M26.

The sixth transistor M26 includes its gate electrode applied with the selection line signal SL, one terminal applied with the turn-on signal TO, and the other terminal connected to the gate electrode of the fifth transistor M25. The sixth transistor M26 transmits the turn-on signal TO of the gate electrode of the fifth transistor M25.

By a method similar to that shown in FIG. 3, all pixels included in the display unit 500 are turned off to be initialized at the initialization period T1, and the organic light emitting diode OLED emits light according to the selection line signal SL of the logic high level and the turn-on signal TO of the logic high level selectively applied to the pixel at the data writing period T2.

Figure 5:
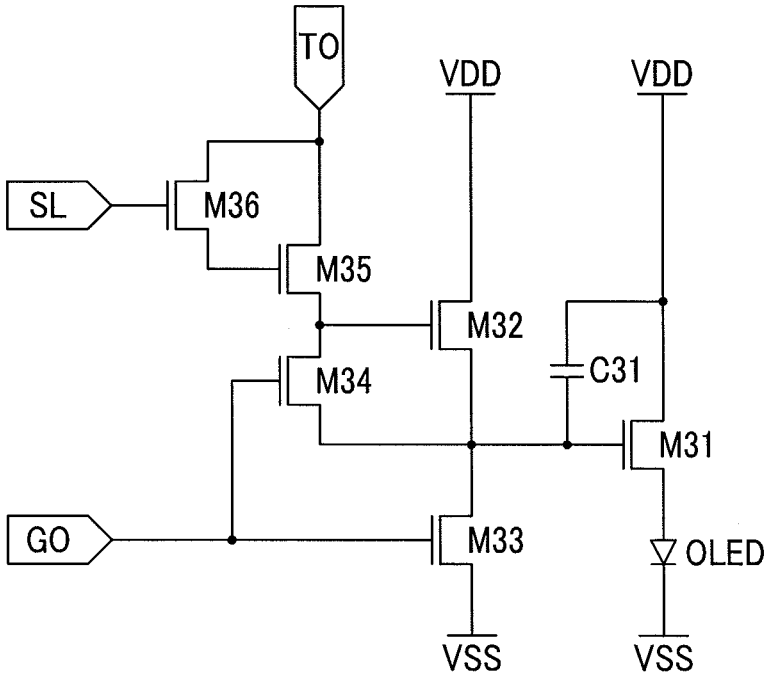
FIG. 5 is a circuit diagram of a pixel according to another exemplary embodiment.

FIG. 5 is a circuit diagram of a pixel according to another exemplary embodiment. Referring to FIG. 5, the pixel includes an organic light emitting diode OLED, a first transistor M31, a second transistor M32, a third transistor M33, a fourth transistor M34, a fifth transistor M35, a sixth transistor M36, and a first capacitor C31.

The first capacitor C31 including one terminal applied with the first power source voltage VDD and the other terminal connected to the gate electrode of the first transistor M31 is further included. During the initialization period T1 the third transistor M33 and the fourth transistor M34 are turned on by the entire off signal GO such that the second power source voltage VSS is transmitted to the gate electrode of the first transistor M31 to turn off the first transistor M31, the first capacitor C31 stores the second power source voltage VSS. The first capacitor C31 operates the first transistor M31 to maintain the turn-off state until the first power source voltage VDD is transmitted to the gate electrode of the first transistor M31 at the data writing period T2.

Figure 6:
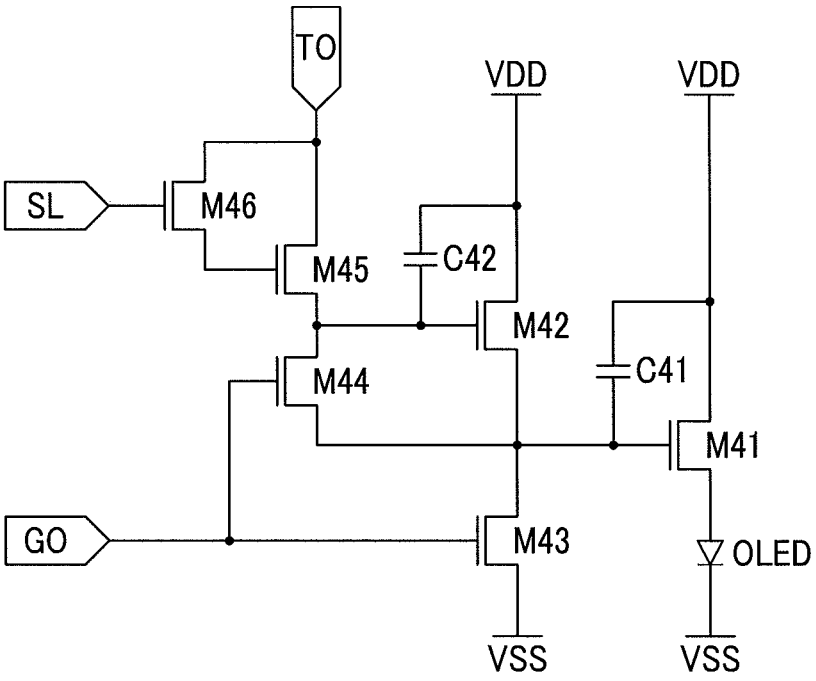
FIG. 6 is a circuit diagram of a pixel according to another exemplary embodiment.

FIG. 6 is a circuit diagram of a pixel according to another exemplary embodiment of the present invention. Referring to FIG. 6, the pixel includes an organic light emitting diode OLED, a first transistor M41, a second transistor M42, a third transistor M43, a fourth transistor M44, a fifth transistor M45, a sixth transistor M46, a first capacitor C41, and a second capacitor C42.

The second capacitor C42 including one terminal applied with the first power source voltage VDD and the other terminal connected to the gate electrode of the second transistor M42 is included. At the data writing period T2, the second capacitor C42 stores the turn-on signal TO transmitted to the gate electrode of the second transistor M42 through the turned on fourth transistor M45. The second capacitor C42 operates the second transistor M42 to maintain the turn-on state until the second power source voltage VSS is transmitted to the gate electrode of the second transistor M42 as the initialization period T1.

The drawings and the detailed description above describe examples of embodiments and are provided to explain various aspects and features. It will be appreciated by those skilled in the art that various modifications may be made and other embodiments are available.

What is claimed is:

1. A pixel for a display device, comprising:

an organic light emitting diode (OLED);

a first transistor configured to transmit a first power source voltage to an anode of the organic light emitting diode (OLED);

a second transistor configured to transmit a gate-on voltage to the gate electrode of the first transistor to turn on the first transistor;

a third transistor configured to transmit a gate-off voltage to the gate electrode of the first transistor according to a first control signal to turn off the first transistor;

a fourth transistor configured to the gate-off voltage to the gate electrode of the second transistor according to the first control signal;

a fifth transistor configured to transmit a second control signal to the gate electrode of the second transistor; and a sixth transistor configured to transmit the gate-on voltage to the gate electrode of the fifth transistor according to a third control signal.

2. The pixel of claim 1, wherein the gate-on voltage is the first power source voltage.

3. The pixel of claim 2, wherein the gate-off voltage is a second power source voltage.

4. The pixel of claim 1, wherein the first control signal is a signal turning off a plurality of pixels included in the display device for initialization.

5. The pixel of claim 1, wherein the third control signal selects one pixel row of a plurality of pixel rows in the display device.

6. The pixel of claim 5, wherein the second control signal selectively turns on one pixel of a plurality of pixels included in the one pixel row.

7. The pixel of claim 1, wherein the sixth transistor includes:

a gate electrode applied with the third control signal;

one terminal applied with the first power source voltage; and another terminal connected to the gate electrode of the fifth transistor.

8. The pixel of claim 1, wherein the sixth transistor includes:

a gate electrode applied with the third control signal;

one terminal applied with the second control signal; and another terminal connected to the gate electrode of the fifth transistor.

9. The pixel of claim 1, further comprising a first capacitor including one terminal applied with the first power source voltage and another terminal connected to the gate electrode of the first transistor.

10. The pixel of claim 1, further comprising a second capacitor including one terminal applied with the first power source voltage and another terminal connected to the gate electrode of the second transistor.

11. A display device comprising:

a display unit including a plurality of pixels;

a scan driver configured to sequentially apply to the display unit a scan signal selecting one pixel row of a plurality of pixel rows;

a data driver configured to apply to the display unit a data signal selectively turning on one pixel of the plurality of pixels included in the one pixel row; and an initialization driver configured to apply an initialization signal substantially simultaneously turning off the plurality of pixels to the display unit, wherein the plurality of pixels respectively include:

an organic light emitting diode (OLED);

a first transistor configured to transmit a first power source voltage to an anode of the organic light emitting diode (OLED);

a second transistor configured to transmit a gate-on voltage to the gate electrode of the first transistor to turn on the first transistor;

a third transistor configured to transmit a gate-off voltage to the gate electrode of the first transistor according to a first control signal to turn off the first transistor;

a fourth transistor configured to transmit a gate-off voltage to the gate electrode of the second transistor according to the initialization signal;

a fifth transistor configured to transmit the data signal to the gate electrode of the second transistor; and a sixth transistor configured to transmit the gate-on voltage to the gate electrode of the fifth transistor according to the scan signal.

12. The display device of claim 11, wherein the gate-on voltage is the first power source voltage.

13. The display device of claim 12, wherein the gate-off voltage is a second power source voltage.

14. The display device of claim 11, wherein the sixth transistor includes:

a gate electrode applied with the scan signal;

one terminal applied with the first power source voltage; and another terminal connected to the gate electrode of the fifth transistor.

15. The display device of claim 11, wherein the sixth transistor includes:

a gate electrode applied with the scan signal;

one terminal applied with the data signal; and another terminal connected to the gate electrode of the fifth transistor.

16. The display device of claim 11, wherein the plurality of pixels further include a first capacitor including one terminal applied with the first power source voltage and another terminal connected to the gate electrode of the first transistor.

17. The display device of claim 11, wherein the plurality of pixels further include a second capacitor including one terminal applied with the first power source voltage and another terminal connected to the gate electrode of the second transistor.

18. A method of driving a display device, the method comprising:

transmitting an off signal to a plurality of pixels to turn off a first transistor transmitting a first power source voltage to an anode of an organic light emitting diode (OLED) and to turn off a second transistor turning on the first transistor; and applying a scan signal to one pixel row of a plurality of pixel rows and applying a data signal selectively turning on one pixel of the plurality of pixels included in the one pixel row, whereby the second transistor of the one pixel is turned on by the data signal and a gate-on voltage is transmitted to the first transistor of the one pixel through the turned on second transistor to turn on the first transistor to provide current to the organic light emitting diode (OLED).

19. The method of claim 18, further comprising transmitting the off signal to the gate electrode of a third transistor to transmit the gate-off voltage to the gate electrode of the first transistor, whereby the third transistor is turned on.

20. The method of claim 18, further comprising transmitting the off signal to the gate electrode of a fourth transistor to transmit the gate-off voltage to the gate electrode of the second transistor, whereby the fourth transistor is turned on.

21. The method of claim 18, further comprising turning on a fifth transistor to transmit the data signal to the gate electrode of the second transistor.

22. The method of claim 21, wherein turning on the fifth transistor includes applying the scan signal to the gate electrode of a sixth transistor to transmit the gate-on voltage to the gate electrode of the fifth transistor.

* * * * *